US006548778B2

(12) United States Patent
Takahashi

(10) Patent No.: US 6,548,778 B2
(45) Date of Patent: Apr. 15, 2003

(54) SHEET WITH PLATE SPRINGS AND SWITCH DEVICE USING SAME

(75) Inventor: Kenichi Takahashi, Miyagi-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 9 days.

(21) Appl. No.: 09/805,095

(22) Filed: Mar. 13, 2001

(65) Prior Publication Data

US 2001/0022270 A1 Sep. 20, 2001

(30) Foreign Application Priority Data

Mar. 16, 2000 (JP) ..... 2000-079340
Oct. 31, 2000 (JP) ..... 2000-337263

(51) Int. Cl.[7] ..... H01H 13/02
(52) U.S. Cl. ..... 200/516; 200/515
(58) Field of Search ..... 200/516, 515, 200/406, 5 A

(56) References Cited

U.S. PATENT DOCUMENTS 4,018,999 A * 4/1977 Robinson et al. ..... 200/5 A
4,046,975 A * 9/1977 Seeger et al. ..... 200/5 A
5,924,555 A 7/1999 Sadamori et al.

* cited by examiner

*Primary Examiner*—Renee Luebke
(74) *Attorney, Agent, or Firm*—Brinks Hofer Gilson & Lione

(57) ABSTRACT

A thin and inexpensive sheet with plate springs is provided which can prevent the entry of dust and other foreign matters and which is strong against static elasticity. One side of an adhesive sheet is studded with adhesive portions in a projected state, and vent portions are formed between the studded adhesive portions and between movable contacts and the exterior of the adhesive sheet to permit the entry and discharge of air. Consequently, the whole upper and lower surfaces of the movable contacts can be covered with the adhesive sheet and a separator to prevent the entry of dust and other foreign matters.

6 Claims, 6 Drawing Sheets

SHEET WITH PLATE SPRINGS AND SWITCH DEVICE USING SAME

BACKGROUND OF THE INVENTION

1. Field of the Invention

The present invention relates to a sheet with plate springs to be used, for example, as a thin operating panel in such an electronic device as a portable telephone set or a video camera, as well as a switch device using the same.

2. Description of the Prior Art

With a panel switch as an example, a conventional sheet with plate springs and a conventional switch device using the conventional sheet with plate springs will be described with reference to FIGS. 10 to 12, of which FIG. 10 is an exploded perspective view of a conventional sheet with plate springs, FIG. 11 is a sectional view taken on line XI—XI in FIG. 10, and FIG. 12 is an explanatory diagram explaining how to assemble a conventional switch device using the conventional sheet with plate springs.

The construction of a conventional sheet with plate springs will now be described with reference to FIGS. 10 and 11. Plural movable contacts 31 are each constituted by a thin, dome-like, metallic plate spring and can be displaced with click feeling when a depressing force is exerted thereon from its top portion.

Film 32 is a generally rectangular, large-sized, somewhat thick film with an adhesive layer affixed to a lower surface thereof. The film 32 has plural holes 32*a* which are formed through upper and lower surfaces of the film and which are each a little larger than each movable contact 31.

The movable contacts 31 are respectively inserted into the holes 32*a*.

A plurality of generally square adhesive sheets 33, which are each a little larger than each hole 32*a*, are each constituted of a film with an adhesive layer affixed to the whole of its lower surface and are each formed with a through hole 33*a* generally centrally of one side of the sheet and in the vicinity of the side edge.

Each adhesive sheet 33 is affixed to an upper surface of each movable contact 31 and also affixed to the surface portion of the film 32 contiguous thereto, thereby fixing the movable contact 31 to the film 32 and holding it on the film.

The through holes 33*a* are respectively opposed to the holes 32*a* of the film with the movable contacts 31 received therein to provide communication of the holes 32*a* with the exterior.

A separator 34 is formed by a large-sized film or paper having substantially the same shape as the film 32. The separator 34 is affixed to the lower surface of the film 32 through the adhesive layer formed on the film lower surface to protect lower surfaces of the movable contacts 31 so that dust and other foreign matters may not get into the interior of each movable contact dome. In this way there is constituted a sheet 35 with movable contacts (a sheet with plate springs).

A conventional switch device and how to assemble it will now be described with reference to FIG. 12. The conventional switch device uses the conventional sheet 35 with movable contacts (sheet with plate springs) and includes a large-sized insulating substrate 36. The insulating substrate 36 is a flexible substrate constituted of a polyimide film for example, and first and second fixed contacts 36*a*, 36*b* are formed on the surface of the insulating substrate 36, for example, by etching copper foil or the like.

The adhesive layer applied to the lower surface of the film 32 in the sheet 35 with movable contacts is exposed by releasing the separator 34 affixed to the film lower surface, allowing the holes 32*a* to be opposed to the first and second fixed contacts 36*a*, 36*b*, and in this state the film 32 is affixed to an upper surface of the insulating substrate 36 to assemble a switch device.

In this state, the movable contacts 31 are placed on the surface of the insulating substrate 36 in such a manner that the peripheral edge of a lower end portion of each movable contact 31 is constantly in contact with the associated second fixed contacts 36*b* and that the dome-like top of each movable contact 31 is spaced from and opposed to the associated first fixed contact 36*a*.

Next, the operation of the conventional switch device constructed as above will be described. If an operator depresses the adhesive sheet 33 located above a movable contact 31 through an operating member (not shown), an upper portion of the movable contact 31 is inverted concavely and comes into contact with the associated first fixed contact 36*a* to turn ON between the first and second fixed contacts 36*a*, 36*b*.

At this time, the air present within the dome of the movable contact 31 flows out from an end portion of the movable contact 31, then passes through the associated hole 32*a* formed in the film 32 and further through the through hole 33*a* formed in the associated adhesive sheet 33, and escapes to the exterior.

Upon release of the depressing force, the upper portion of the movable contact 31 leaves the first fixed contact 36*a*, thus turning OFF between the first and second fixed contacts 36*a*, 36*b*.

At this time, air flows into the dome through the through hole 33*a* formed in the adhesive sheet 33.

However, since the conventional sheet with plate springs requires the film 32 for insertion therein of the movable contacts 31 formed of plate springs and also requires the adhesive sheets 33 for fixing the movable contacts adhesively, the number of components used is large to result in an increase of cost.

In addition, since the adhesive sheets 33 are affixed to the movable contacts 31 (plate springs) one by one, considerable time and labor are required for the affixing work, thus giving rise to the problem that the productivity is low.

Moreover, since the holes 32*a* formed in the film 32 are directly connected to the exterior through the through holes 33*a* formed in the adhesive sheets 33, dust and other foreign matters are apt to get into the holes 32*a* from the exterior.

Further, in the conventional switch device using the conventional sheet with plate springs, not only dust and other foreign matters are apt to get into the holes 32*a* of the film 32 from the exterior because the holes 32*a* are in direct communication with the exterior, but also in the case where electronic parts are mounted on the insulating substrate 36, the electronic parts become more likely to be destroyed by static electricity charged on the hands and fingers of the operator.

Further, since the film 32 having holes 32*a* for fitting therein of the movable contacts 31 (plate springs), as well as plural adhesive sheets 33, are required, the productivity is low, the number of components used increases, the cost becomes high, and the thickness of the switch device increases.

SUMMARY OF THE INVENTION

It is an object of the present invention to provide a sheet with plate springs capable of preventing the entry of dust and other foreign matters from the exterior and which is inexpensive, as well as a switch device capable of preventing the entry of dust and other foreign matters from the exterior and which is thin and strong against static electricity.

According to a first apparatus adopted by the invention for solving the above-mentioned problems there is provided a sheet with plate springs, comprising an adhesive sheet having adhesive portions on one side thereof, a plurality of plate springs each constituted of a deformable metallic plate having resilience and with the adhesive portions affixed to upper surfaces thereof, and a sheet-like separator affixed to the adhesive sheet to protect lower surfaces of the plate springs, wherein the one side of the adhesive sheet is studded with the adhesive portions each in a projected form, and vent portions are formed between the studded and projected adhesive portions and between the plate springs and the exterior of the adhesive sheet so that air can get into and out of the vent portions.

According to a second apparatus adopted by the invention there is provided, in combination with the above first apparatus, a sheet with plate springs wherein the total area of the adhesive portions studded and projected on the one side of the adhesive sheet is larger than the total area of the one side portion of the adhesive sheet where the adhesive portions are not projected.

According to a third apparatus adopted by the invention there is provided, in combination with the above first apparatus, a sheet with plate springs wherein the area of each of the studded and projected adhesive portions is smaller than the area of the upper surface of each of the plate springs.

According to a fourth apparatus adopted by the invention there is provided, in combination with the above third apparatus, a sheet with plate springs wherein the spacing between adjacent studded and projected portions of the adhesive is smaller than the size of each of the plate springs.

According to a fifth apparatus adopted by the invention there is provided, in combination with the above first apparatus, a sheet with plate springs wherein the adhesive portions are colored.

According to a sixth apparatus adopted by the invention there is provided, in combination with the above first apparatus, a sheet with plate springs wherein the projected adhesive portions each have a polygonal shape and are arranged regularly.

According to a seventh apparatus adopted by the invention there is provided, in combination with the above sixth apparatus, a sheet with plate springs wherein the projected adhesive portions each have a hexagonal shape.

According to an eighth apparatus adopted by the invention there is provided, in combination with the above first apparatus, a sheet with plate springs wherein the projected adhesive portions each have a generally circular shape and are arranged regularly.

According to a ninth apparatus adopted by the invention there is provided, in combination with the above first apparatus, a sheet with plate springs wherein either the adhesive sheet or the separator is made transparent or translucent and the other is made opaque.

According to a tenth apparatus adopted by the invention there is provided a switch device comprising an adhesive sheet whose lower surface is studded with adhesive portions, movable contacts constituted by a plurality of plate springs whose upper surfaces are affixed to the adhesive portions, the plate springs each being constituted of a deformable metallic plate having resilience, and an insulating substrate having a plurality of fixed contacts, wherein the adhesive portions studded and projected on the lower surface of the adhesive sheet are affixed to the insulating substrate in a state such that the movable contacts affixed to the adhesive sheet through the adhesive portions are opposed to the fixed contacts of the insulating substrate, and vent portions are formed between the studded and projected adhesive portions and between the movable contacts and the exterior of the adhesive sheet so that air can get into and out of the vent portions.

According to an eleventh apparatus adopted by the invention there is provided, in combination with the above tenth apparatus, a switch device wherein the total area of the adhesive portions studded and projected on the lower surface of the adhesive sheet is larger than the total area of the lower surface portion of the adhesive sheet where the adhesive portions are not projected.

According to a twelfth apparatus adopted by the invention there is provided, in combination with the above tenth apparatus, a switch device wherein the area of each of the studded and projected adhesive portions is smaller than the area of the upper surface of each of the movable contacts.

According to a thirteenth apparatus adopted by the invention there is provided, in combination with the above tenth apparatus, a switch device wherein the projected adhesive portions each have a polygonal shape and are arranged regularly.

According to a fourteenth apparatus adopted by the invention there is provided, in combination with the above thirteenth apparatus, a switch device wherein the projected adhesive portions each have a hexagonal shape.

According to a fifteenth apparatus adopted by the invention there is provided, in combination with the above tenth apparatus, a switch device wherein the projected adhesive portions each have a generally circular shape and are arranged regularly.

According to the fifteenth solving means adopted by the invention there is provided, in combination with the above tenth means, a switch device wherein the projected adhesive portions each have a generally circular shape and are arranged regularly.

DETAILED DESCRIPTION OF PREFERRED EMBODIMENTS

Figure 1:
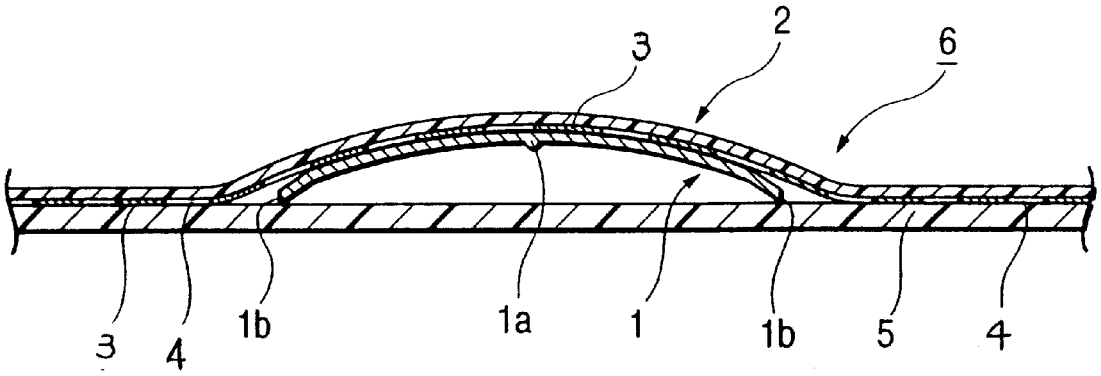
FIG. 1 is a sectional view of a principal portion of a sheet with plate springs according to the first embodiment of the present invention.
Figure 2:
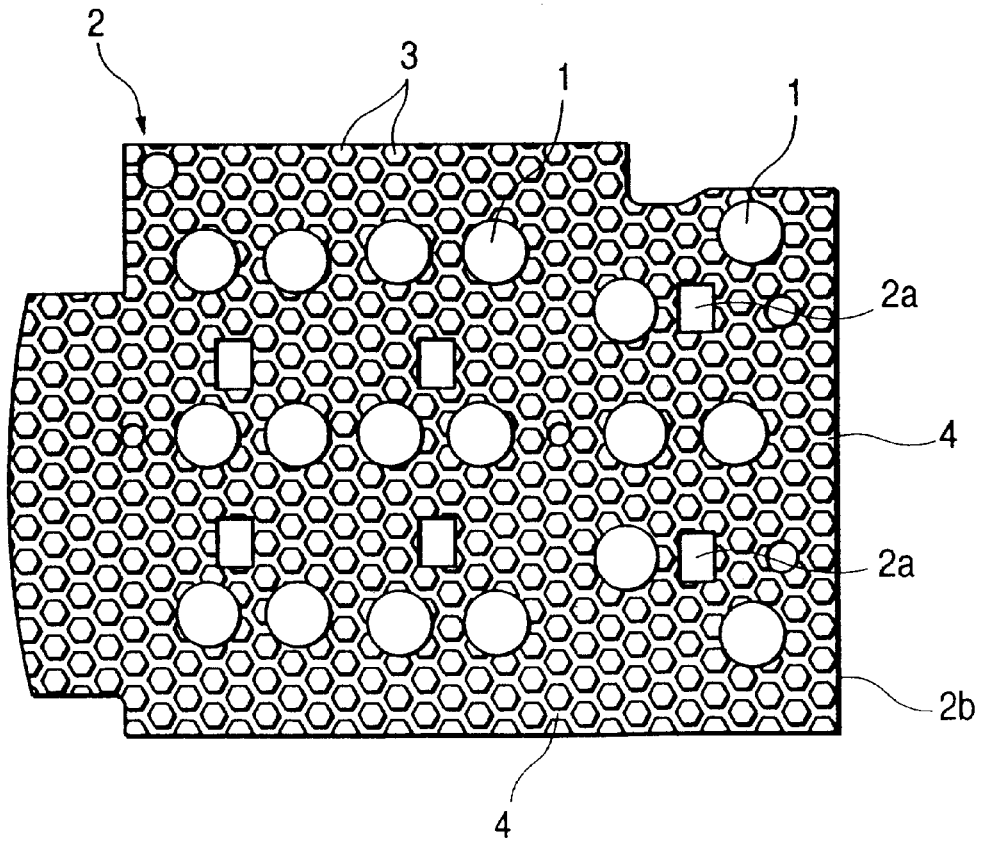
FIG. 2 is a rear view of an adhesive sheet with plate springs affixed thereto, which is used in the first embodiment.
Figure 3:
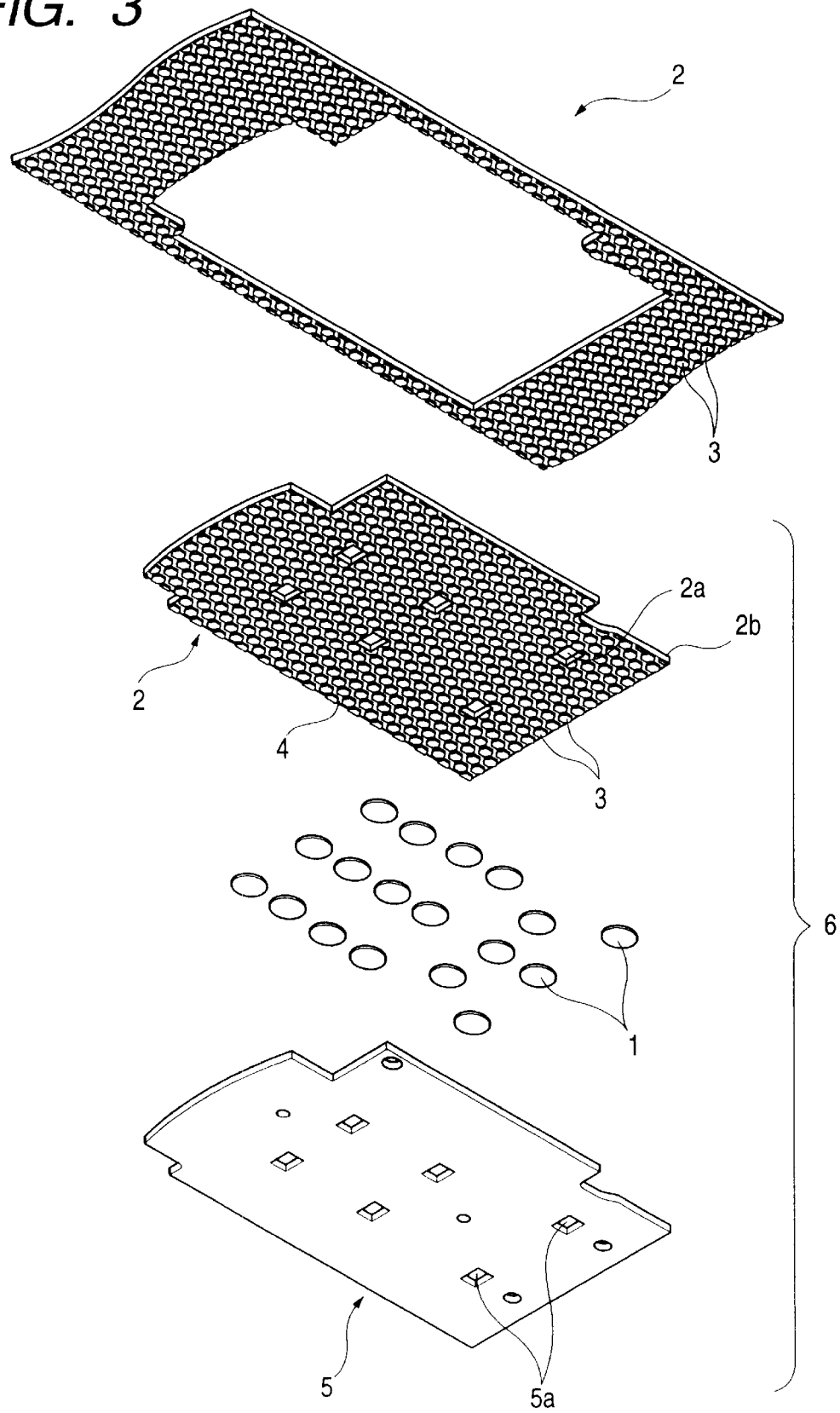
FIG. 3 is an exploded perspective view showing the construction of the sheet with plate springs according to the first embodiment and also showing a manufacturing method for the sheet.

Reference will now be made to the drawings of sheets with plate springs embodying the present invention and a switch device using any of the sheets with plate springs. FIG. 1 is a sectional view of a principal portion of a sheet with plate springs according to the first embodiment of the present invention, FIG. 2 is a rear view of an adhesive sheet with plate springs affixed thereto, which is used in the first embodiment, FIG. 3 is an exploded perspective view showing the construction of the sheet with plate springs according to the first embodiment and also showing a manufacturing method for the sheet.

Figure 4:
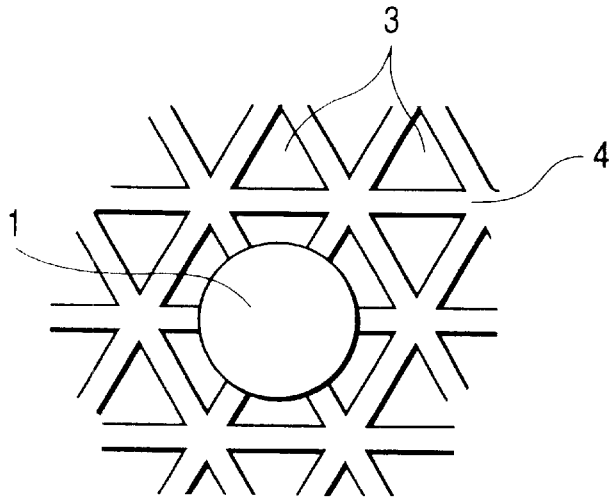
FIG. 4 is an enlarged rear view of a principal portion of an adhesive sheet with plate springs affixed thereto, which is used in a sheet with plate springs according to the second embodiment of the present invention.
Figure 5:
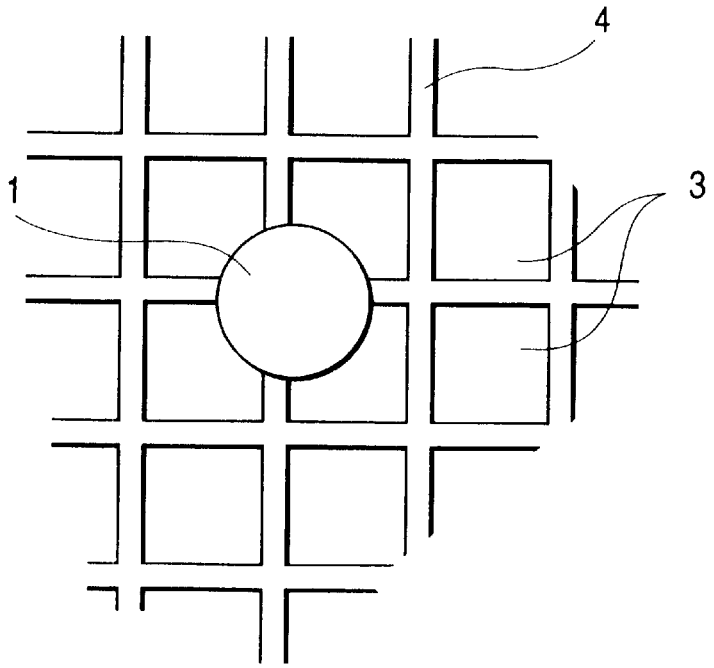
FIG. 5 is an enlarged rear view of a principal portion of an adhesive sheet with plate springs affixed thereto, which is used in a sheet with plate springs according to the third embodiment of the present invention.
Figure 6:
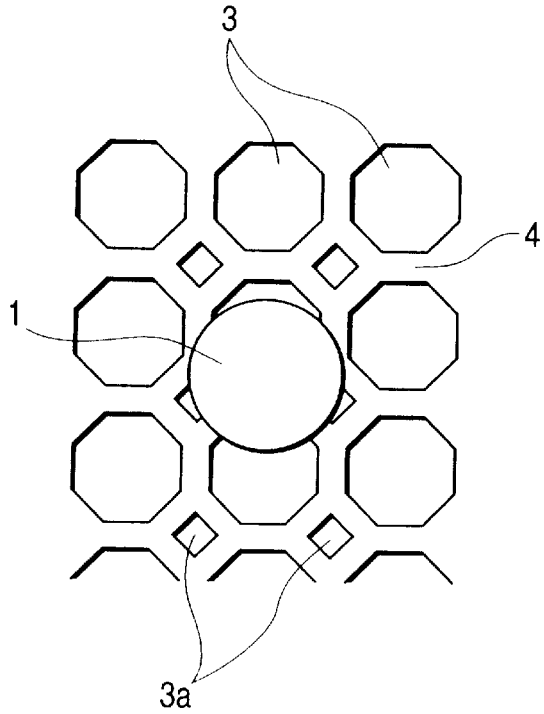
FIG. 6 is an enlarged rear view of a principal portion of an adhesive sheet with plate springs affixed thereto, which is used in the sheet with plate springs according to the fourth embodiment of the present invention.
Figure 7:
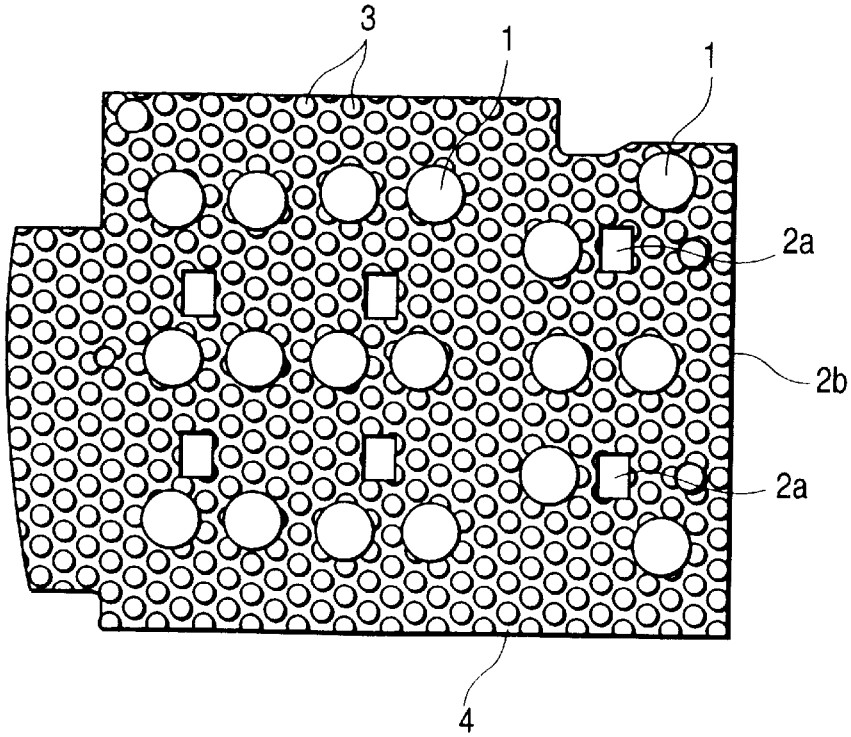
FIG. 7 is a rear view of an adhesive sheet with plate springs affixed thereto, which is used in a sheet with plate springs according to the fifth embodiment of the present invention.
Figure 8:
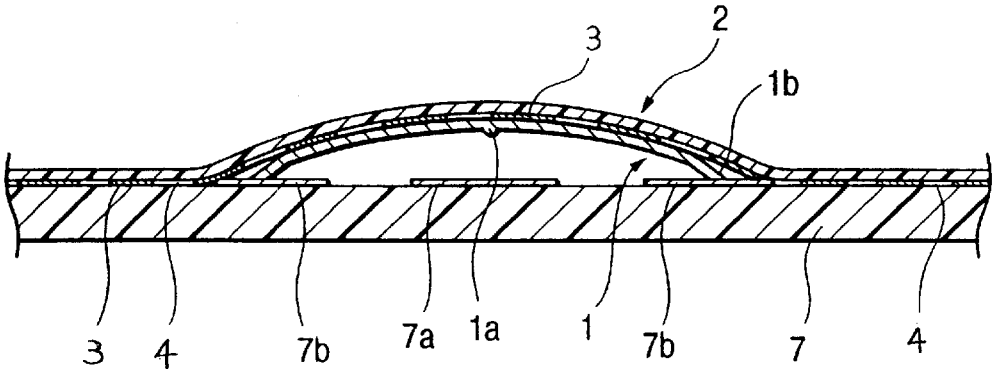
FIG. 8 is a sectional view of a principal portion of a switch device using a sheet with plate springs according to the present invention.
Figure 9:
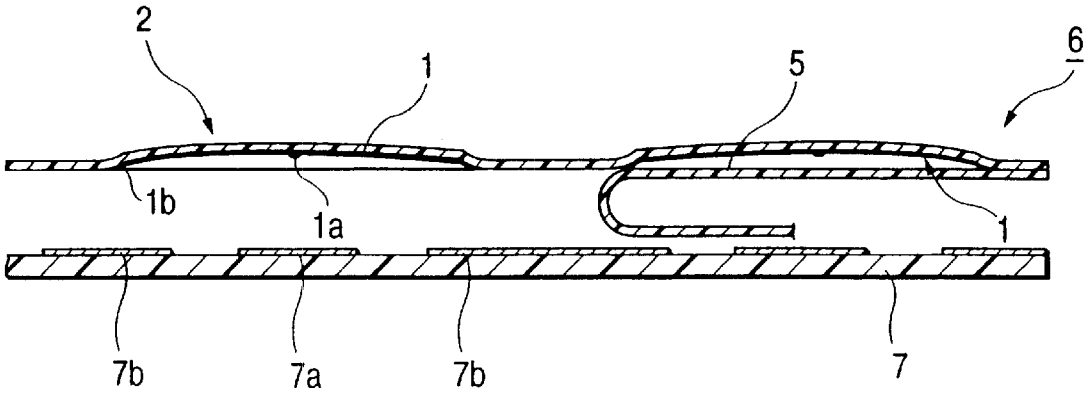
FIG. 9 is an explanatory diagram explaining how to assemble the switch device.
Figure 10:
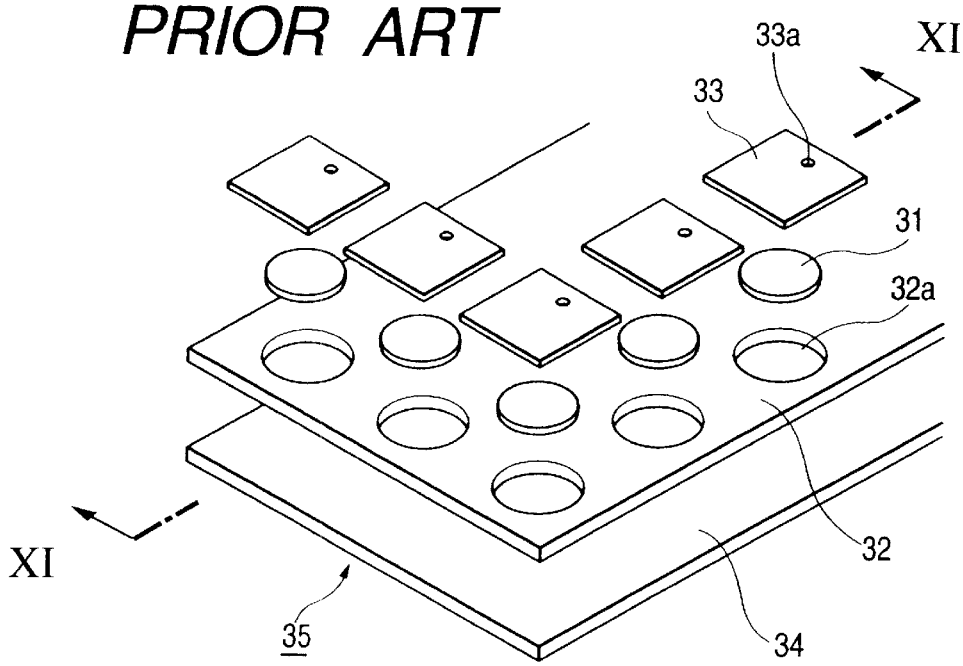
FIG. 10 PRIOR ART
FIG. 10 is an exploded perspective view of a conventional sheet with plate springs.
Figure 11:
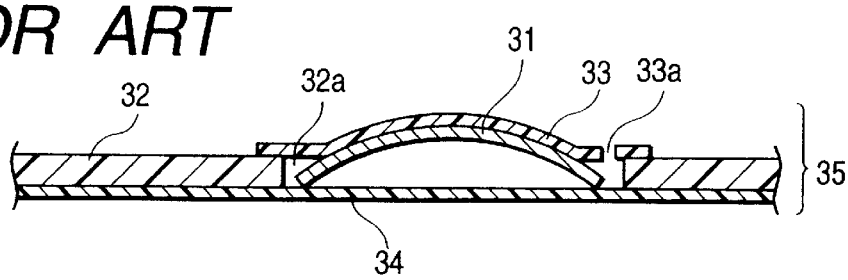
FIG. 11 PRIOR ART
FIG. 11 is a sectional view taken on line XI—XI in FIG. 10.
Figure 12:
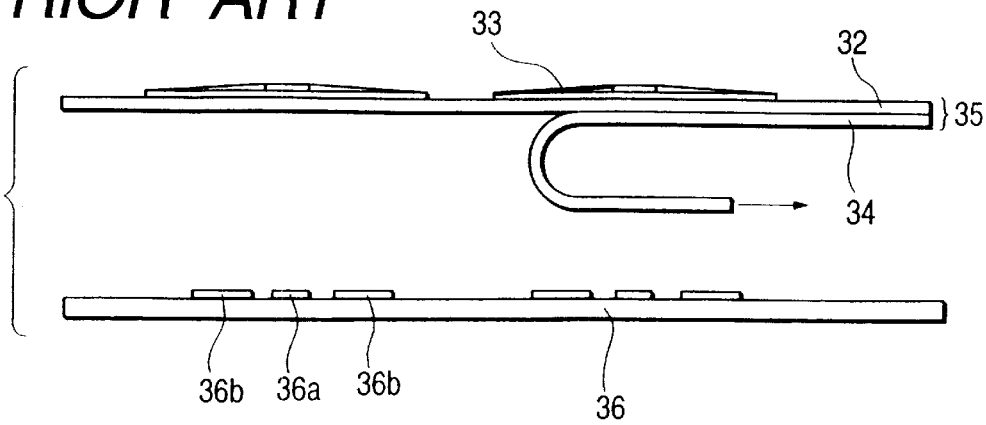
FIG. 12 PRIOR ART
FIG. 12 is an explanatory diagram explaining how to assemble a conventional switch device using the conventional sheet with plate springs, in which a separator is released from the sheet with plate springs and the sheet is affixed to an insulating substrate.

FIG. 4 is an enlarged rear view of a principal portion of an adhesive sheet with plate springs affixed thereto, which is used in a sheet with plate springs according to the second embodiment of the present invention, FIG. 5 is an enlarged rear view of a principal portion of an adhesive sheet with plate springs affixed thereto, which is used in a sheet with plate springs according to the third embodiment of the present invention, FIG. 6 is an enlarged rear view of a principal portion of an adhesive sheet with plate springs affixed thereto, which is used in a sheet with plate springs according to the fourth embodiment of the present invention, FIG. 7 is a rear view of an adhesive sheet with plate springs affixed thereto, which is used in a sheet with plate springs according to the fifth embodiment of the present invention, FIG. 8 is a sectional view of a principal portion of a switch device using a sheet with plate springs according to the present invention, and FIG. 9 is an explanatory diagram explaining how to assemble the switch device.

The construction of a sheet with plate springs according to the first embodiment of the present invention will now be described with reference to FIGS. 1 to 3. Plural movable contacts 1 are each formed of a thin dome-like metallic plate having resilience such as, for example, a thin stainless steel or phosphor bronze plate and can be displaced with click feeling when subjected to a depressing force applied from top portions thereof.

Each movable contact 1 does not have any through hole in its dome, but is centrally formed with a contact portion la projecting toward the interior of the dome.

An adhesive sheet 2 is a film about 25 to 100 $\mu$m thick which is formed using a polyester resin for example and which is colored in white, and colored, acrylic adhesive portions 3 are formed on the adhesive sheet 2 to a thickness of about 15 to 35 $\mu$m by printing.

The adhesive portions 3 are colored in a color (e.g., green) different from the film color (white) of the adhesive sheet 2 by mixing a pigment therein.

The adhesive sheet 2 possesses slight expanding and contracting properties (flexibility) and is formed with plural holes 2*a*. The adhesive portions 3, which are each in a hexagonal shape as a polygonal shape, are downwardly projected and regularly studded on a lower surface as one side of the adhesive sheet 2. They are arranged in such a honeycomb shape as shown in FIGS. 2 and 3.

Vent portions 4 which will be described later are formed between the projected and studded adhesive portions 3 so as to permit the entry and escape of air between, for example, a central portion of the adhesive sheet 2 and the holes 2*a* or outer edges 2*b* of the adhesive sheet.

The adhesive portions 3 may be arranged not only in such a honeycomb shape as shown in FIG. 2, but also in such a regular shape as the squares of a checkerboard, a concentric shape, or a spiral shape. The arrangement of the adhesive portions 3 need not always be regular.

A total area of the sheet surface where the adhesive portions 3 in the adhesive sheet 2 are projected and formed is larger than the total area (i.e., a total area of the vent portions 4) where the adhesive portions 3 in the sheet surface are not projected and formed, and the area of each of the adhesive portions 3 is smaller than the area of an upper surface of each movable contact 1.

Further, the spacing between adjacent adhesive portions 3 is set smaller than the size (diameter) of each movable contact (plate spring) 1.

The adhesive portions 3 may each be formed so as not to cover the upper surface of each movable contact 1 completely. In this case, the area of each adhesive portion 3 may be larger than the area of the upper surface of each movable contact 1.

The movable contacts 1 are conveyed to a predetermined position on the adhesive sheet 2 by means of a mounter in a state such that their upper surfaces are affixed to the adhesive portions 3 of the adhesive sheet 2 and that their upper surfaces and end portions 1*b* are positioned at least partially in the vent portions 4.

A separator 5 is constituted of a transparent polyester film whose shape is substantially the same as the shape of the adhesive sheet 2, and a release agent is applied to an upper surface of the separator 5 so as to permit easy release of the separator from the adhesive sheet 2.

The separator 5 has plural holes 5*a* (see FIG. 3) which are formed as through holes extending through upper and lower surfaces of the separator. The separator 5 is affixed to the lower surface of the adhesive sheet 2 so that its holes 5*a* and the holes 2*a* of the adhesive sheet 2 are superimposed one on the other through the adhesive portion 3 on the adhesive sheet 2.

The separator 5 sandwiches the movable contacts 1 in between it and the adhesive sheet 2 and protects the lower surface of the movable contacts 1 so that dust and other foreign matters may not get into the domes of the movable contacts 1, thereby constituting a sheet 6 with movable contacts (a sheet with plate springs).

Since the separator 5 is transparent, the positions of the movable contacts 1 and the presence of foreign matters, if any, can be seen through.

At this time, vent portions 4 are formed between the projected adhesive portions 3 and between the separator 5 and the adhesive sheet 2. The vent portions 4 extend from the end portions 1*b* of the movable contacts 1 and are connected to the holes 2*a* and the outer edges 2*b*.

Now, with reference to FIG. 3, a description is now directed to a manufacturing method for the sheet 6 with plate springs as movable contacts constructed as above. First, a band-like adhesive sheet 2 is provided, though the illustrated one is not in a belt form, whose one side is studded with adhesive portions 3 projectingly by screen printing.

Next, movable contacts 1 are affixed to predetermined positions on the adhesive sheet 2 by means of a mounter and thereafter a belt-like separator 5 having the same shape as the adhesive sheet 2, though the illustrated one is not in a belt form, is affixed to the adhesive tape 2.

Subsequently, the adhesive tape 2 and the separator 5 are punched simultaneously into a desired shape with use of a punching die. The fabrication of the sheet 6 with plate springs as movable contacts is completed in this way.

At the same time, in addition to the external form, there also are formed holes 2*a* and 5*a* for mounting LEDs (light emitting diodes) therein, as well as other holes, etc., if required.

In the present invention, a transparent polyester film maybe used as the base film of the adhesive sheet 2, and a colored (e.g. white or blue) paper (release paper) may be used as the separator 5. As the adhesive sheet 2 there may be used a colored, translucent sheet if only it can transmit light.

FIG. 4 illustrates a sheet with plate springs according to the second embodiment of the present invention. In this second embodiment, adhesive portions 3 are studded and projected each in a triangular shape.

Other constructional components adopted in this second embodiment are the same as in the previous first embodiment, so will be identified by the same reference numerals as in the first embodiment and explanations thereof will here be omitted.

FIG. 5 illustrates a sheet with plate springs according to the third embodiment of the present invention. In this third embodiment, adhesive portions 3 are studded and projected each in a square shape.

Other constructional components adopted in this third embodiment are the same as in the previous first embodiment, so will be identified by the same reference numerals as in the first embodiment and explanations thereof will here be omitted.

FIG. 6 illustrates a sheet with plate springs according to the fourth embodiment of the present invention. In this fourth embodiment, studded and projected adhesive portions 3 are each in a hexagonal shape and a small dot-like adhesive portion 3*a* is disposed in a central portion surrounded with such hexagonal adhesive portions 3.

Other constructional components adopted in this embodiment are the same as in the first embodiment, so will be identified by the same reference numerals as in the first embodiment and explanations thereof will here be omitted.

FIG. 7 illustrates a sheet with plate springs according to the fifth embodiment of the present invention. In this fifth embodiment, studded and projected adhesive portions 3 are each in a generally circular shape such as a circle or an ellipse.

Other constructional components adopted in this embodiment are the same as in the first embodiment, so will be identified by the same reference numerals as in the first embodiment and explanations thereof will here be omitted.

Although in all of the above first to fifth embodiments, no adhesive is present between the projected adhesive portions 3, there is made no limitation thereto. For example, there may be adopted a modification wherein an adhesive is applied to the whole of one side of the adhesive sheet 2, the adhesive is studded with projections, and vent portions are formed between the projections.

A switch device according to the present invention is illustrated in FIGS. 8 and 9. This switch device uses the foregoing sheet with movable contacts (sheet with plate springs) 6 and also uses an insulating substrate 7 which is about the same in size as the sheet 6 with movable contacts. The insulating substrate 7 is a flexible substrate such as a polyimide film. First circular fixed contacts 7*a* and second C-shaped fixed contacts 7*b* are formed on the surface of the insulating substrate 7 by etching copper foil, the second fixed contacts 7*b* being formed so as to surround the first fixed contacts 7*a*.

Further, wiring patterns (not shown) are formed on the surface of the insulating substrate 7 simultaneously with the formation of the first and second fixed contacts 7*a*, 7*b*. Chip LEDs (not shown) are connected to predetermined wiring patterns by soldering or any other suitable means.

The insulating substrate 7 may be a polyester film and the first and second fixed contacts 7*a*, 7*b* may be conductive patterns such as silver patterns formed by printing or may even be formed by etching copper foil on a rigid substrate such as a glass-contained epoxy substrate.

As shown in FIG. 9, by releasing the separator 5 affixed to the lower surface of the adhesive sheet 2 in the sheet with movable contacts 6, the adhesive portions 3 on the adhesive sheet 2 is exposed, and the adhesive sheet 2 is affixed to an upper surface of the insulating substrate 7 in an opposed state of end portions 1*b* of the movable contacts 1 to the second fixed contacts 7*b*.

At this time, the movable contacts 1 are placed on the surface of the insulating substrate 7 while the peripheral edges of their end portions 1*b* are constantly in contact with the second fixed contacts 7*b*. Further, the chip LEDs (not shown) mounted to the insulating substrate 7 are projected from the holes 2*a* of the adhesive sheet 2.

By such a configuration there is formed an operating panel section with illumination in a portable telephone set for example, in which the chip LEDs function to illuminate operating members (operating buttons) (not shown) which are for depressing the movable contacts 1.

Vent portions 4 are formed between the projected adhesive portions 3 and between the adhesive sheet 2 and the insulating substrate 7. The vent portions 4 extend from the end portions 1*b* of the movable contacts 1 and are connected to the holes 2*a* and outer edges 2*b*.

The following description is now provided about the operation of the switch device according to the present invention which is constructed as above. When an operator depresses, through an operating member (not shown), the adhesive sheet 2 at a position corresponding to a movable contact 1, the upper portion of the movable contact 1 is inverted concavely with click feeling, the contact portion la comes into contact with the first fixed contact 7*a*, so that the first and second fixed contacts 7*a*, 7*b* are rendered conductive with each other and are turned ON.

At this time, the air present within the dome of the movable contact 1 flows out from the end portions 1*b* of the movable contact 1, then passes through the vent portions 4 and escapes to the exterior from the holes 2*a* formed in the adhesive sheet 2 or from the outer edges 2*b* of the adhesive sheet 2.

Upon release of the depressing force, the upper portion (contact portion 1*a*) of the movable contact 1 leaves the first fixed contact 7*a*, making the first and second fixed contacts 7*a*, 7*b* non-conductive, i.e., turning them OFF.

At this time, air gets into the dome through the vent portions 4.

In the sheet with plate springs according to the present invention, one side of the adhesive sheet 2 is studded with projected adhesive portions 3, and vent portions 4 are formed between the thus studded and projected adhesive portions 3 and between the deformable plate spring 1 as a movable contact and the exterior of the adhesive sheet 2, to permit the entry and discharge of air. Therefore, the whole upper and lower surfaces of the plate springs (movable contacts 1) can be covered with both adhesive sheet 2 and separator 5 and thus it is possible to provide a sheet with plate springs capable of preventing the entry of dust and other foreign matters.

Moreover, since the conventional work of placing the movable contact (plate springs) 31 in the holes 32*a* of the film 32 and affixing the movable contacts 31 one by one to the adhesive sheet 33, it is possible to enhance the productivity and the working efficiency.

Further, since the separator 5 is attached directly to the adhesive sheet 2, it is not necessary to use such adhesive films 33 as in the prior art, thus permitting the provision of a less expensive sheet with plate springs.

Further, since the total area of the adhesive portions 3 studded and projected on one side of the adhesive sheet 2 is larger than the total area of the one side portion of the adhesive sheet where the adhesive portions 3 are not projected, there is obtained a large adhesive area and it is possible to provide a sheet with plate springs which permits the plate springs (movable contacts 1) to be adhered to the adhesive sheet 2 positively.

Further, since the area of each of the studded and projected adhesive portions 3 is set smaller than the area of the upper surface of each plate spring (movable contact 1), the adhesive portion 3 do not cover the whole circumference of the end portion 1*b* of each plate spring (movable contact 1), thus ensuring the vent portions 4 from the plate spring (movable contact 1).

Further, since the spacing between adjacent projected adhesive portions 3 is set smaller than the size of each plate spring (movable contact 1), even when the plate springs (movable contacts 1) are affixed to arbitrary positions, it is not necessary to separately provide a new adhesive sheet 2 and thus it is possible to provide a sheet with plate springs which is versatile and which can cope with various requests.

Further, since the adhesive portions 3 are colored, it is possible to visually check whether the adhesive portions are formed in a desired shape or not after their formation by printing for example. Thus, it becomes easy to check the quality of the adhesive portions 3.

When the projected adhesive portions 3 are each in a polygonal shape, the area of each adhesive portion 3 which contributes to adhesion can be made large, thereby ensuring the adhesion of the plate springs (movable contacts 1). In addition, by arranging the adhesive portions 3 regularly, the adhesion of the plate springs (movable contacts 1) can be further ensured.

When the projected adhesive portions 3 are each in a hexagonal shape, the adhesive portions 3 can be formed in such a manner that vent portions 4 get in between two adhesive portions 3 in rows adjacent to each other so as to be formed in a zigzag fashion, thus further ensuring the adhesion of the plate springs (movable contacts 1).

When the projected adhesive portions 3 are each formed in a generally circular shape, there is obtained a combination of circular shapes in case of using dome-like plate springs (movable contacts 1), thereby ensuring adhesion of the plate springs (movable contacts 1) and ensuring the formation of vent portions 4. In addition, by arranging the adhesive portions 3 regularly it is possible to further ensure the adhesion of the plate springs (movable contacts 1).

Further, since either the adhesive sheet 2 or the separator 5 is made transparent or translucent and the other opaque, it is possible to find out a positional displacement of a plate spring (movable contact 1) and the presence of dust easily visually, thus facilitating the inspection of quality.

Further, the adhesive portions 3 which are studded and projected on the lower surface of the adhesive sheet 2 in a state such that the movable contacts 1 each constituted of a plate spring are opposed to the fixed contacts 7*a* and 7*b*, and vent portions 4 are formed between the studded and projected adhesive portions 3 and between the movable contacts 1 and the exterior of the adhesive sheet 2, to permit the entry and discharge of air. Thus, the whole upper and lower surfaces of the movable contacts 1 can be covered with the adhesive sheet 2 and the insulating substrate 7; in other words, it is possible to provide a switch device which can prevent the entry of dust and other foreign matters and which is strong against static electricity.

Since the separator 5 is attached directly to the adhesive sheet 2, it is not required to use such a film 32 as in the prior art, thus permitting the provision of a less expensive switch device.

Further, since the total area of the adhesive portions 3 which are studded and projected on the lower surface of the adhesive sheet 2 is set larger than the total area of the lower surface portion of adhesive sheet where the adhesive portions 3 are not projected, there is obtained a large area for adhesion and it is possible to provide a switch device wherein the adhesive sheet 2 can be firmly adhered to the movable contacts 1 and the insulating substrate 7.

Since the area of each of the studded and projected adhesive portions 3 is set smaller than the area of the upper surface of each movable contact 1, the adhesive portion 3 does not cover the whole circumference of the end portion 1*b* of the movable contact 1, thus permitting the provision of a switch device which can ensure the formation of vent portions 4 from the movable contacts 1.

Where the projected adhesive portions 3 are each in a polygonal shape, the area of each adhesive portion 3 which contributes to the adhesion can be made large, thereby ensuring the adhesion of the plate springs (movable contacts 1). In addition, by arranging the adhesive portions 3 regularly, it is possible to provide a switch device wherein the adhesion of the plate springs (movable contacts 1) can be further ensured.

Where the projected adhesive portions 3 are each in a hexagonal shape, the adhesive portions 3 can be formed in such a manner that vent portions 4 get in between two adhesive portions 3 in rows adjacent to each other so as to be formed in a zigzag fashion, thus permitting the provision of a switch device which can further ensure the adhesion of the plate springs (movable contacts 1).

Further, when the projected adhesive portions 3 are each formed in a generally circular shape, there is obtained a combination of circular shapes in case of using dome-like plate springs (movable contacts 1), thereby ensuring the adhesion of the plate springs (movable contacts 1) and ensuring the formation of vent portions 4. In addition, by arranging the adhesive portions 3 regularly, it is possible to provide a switch device which can further ensure the adhesion of the plate springs (movable contacts 1).

What is claimed is:

1. A sheet with plate springs, comprising:

an adhesive sheet having adhesive portions on one side thereof;

a plurality of plate springs each constituted of a deformable metallic plate having resilience and with the adhesive portions affixed to upper surfaces thereof; and a sheet-like separator affixed to the adhesive sheet to protect lower surfaces of the plate springs, wherein the one side of the adhesive sheet is studded with the adhesive portions each in a projected form, and vent portions are formed between the studded and projected adhesive portions and between the plate springs and an exterior of the adhesive sheet so that air gets in and out of the vent portions, wherein the area of each of the studded and projected adhesive portions is smaller than the area of the upper surface of each of the plate springs, and wherein the spacing between adjacent studded and projected portions of the adhesive is smaller than the size of each of the plate springs.

2. A sheet with plate springs according to claim 1, wherein the adhesive portions are colored.

3. A sheet with plate springs according to claim 1, wherein the projected adhesive portions each have a polygonal shape and are arranged regularly.

4. A sheet with plate springs according to claim 3, wherein the projected adhesive portions each have a hexagonal shape.

5. A sheet with plate springs according to claim 1, wherein the projected adhesive portions each have a generally circular shape and are arranged regularly.

6. A sheet with plate springs according to claim 1, wherein either the adhesive sheet or the separator is made transparent or translucent and the other is made opaque.

* * * * *